US009068769B2

(12) United States Patent
Tadano et al.

(10) Patent No.: US 9,068,769 B2
(45) Date of Patent: Jun. 30, 2015

(54) OIL SEPARATOR AND REFRIGERATING CYCLE APPARATUS USING THE SAME

(75) Inventors: Rikio Tadano, Maebashi (JP); Hiroyuki Satou, Kounosu (JP); Susumu Kobayashi, Oizumi-machi (JP); Hiroshi Yamawaki, Oizumi-machi (JP)

(73) Assignee: PANASONIC HEALTHCARE CO., LTD., Toon-shi (JP)

( * ) Notice: Subject to any disclaimer, the term of this patent is extended or adjusted under 35 U.S.C. 154(b) by 540 days.

(21) Appl. No.: 13/416,655

(22) Filed: Mar. 9, 2012

(65) Prior Publication Data

US 2012/0234037 A1 Sep. 20, 2012

(30) Foreign Application Priority Data

Mar. 16, 2011 (JP) ..... 2011-057892

(51) Int. Cl.
*F25B 43/02* (2006.01)

(52) U.S. Cl.
CPC ..... *F25B 43/02* (2013.01); *F25B 2500/06* (2013.01); *F25B 2700/03* (2013.01)

(58) Field of Classification Search
CPC ..... F25B 45/00; F25B 43/02; F25B 43/006; F25B 31/004; F25B 2345/001; Y02B 30/62
USPC ..... 62/77, 85, 149, 196.4, 292, 474, 498, 62/470; 210/167.02
See application file for complete search history.

(56) References Cited

U.S. PATENT DOCUMENTS 3,850,554 A * 11/1974 Zimmern ..... 418/84
5,095,713 A * 3/1992 Laukhuf et al. ..... 62/149
5,325,675 A * 7/1994 Manz et al. ..... 62/77
5,363,662 A * 11/1994 Todack ..... 62/85
6,244,055 B1 * 6/2001 Hanson et al. ..... 62/85
6,314,749 B1 * 11/2001 Van Steenburgh, Jr. ..... 62/292

FOREIGN PATENT DOCUMENTS

| | | | |
|---|---|---|---|
| CN | 2893562 | Y | 4/2007 |
| EP | 1106229 | A1 | 6/2001 |
| JP | 09-72635 | A | 3/1997 |
| JP | 09-072635 | A | 3/1997 |
| JP | 2000-227356 | A | 8/2000 |
| JP | 2005-54702 | A | 3/2005 |
| JP | 2010-65586 | A | 3/2010 |
| SU | 417667 | A1 | 2/1974 |

OTHER PUBLICATIONS

Extended European Search Report dated Jun. 4, 2012, issued in corresponding European Patent Application 12157699.5.

* cited by examiner

*Primary Examiner* — Melvin Jones
(74) *Attorney, Agent, or Firm* — Westerman, Hattori, Daniels & Adrian, LLP

(57) ABSTRACT

An oil separator capable of preventing breakage in a float with an extremely simple configuration is provided. An oil separator is to separate oil in a refrigerant that is discharged from a compressor and return the oil to the compressor. The oil separator includes: a tank, into which a refrigerant discharged from the compressor flows; a float having a hollow therein that is held vertically movably in the tank, the float moving up and down with a change of an oil level in the tank; and a needle valve to return oil in the tank to the compressor in accordance with up/down movement of the float. The float includes an equalizing tube having a lower end that opens at a bottom part in the float and an upper end that opens outside of the float and above the oil level in the tank.

5 Claims, 8 Drawing Sheets

OIL SEPARATOR AND REFRIGERATING CYCLE APPARATUS USING THE SAME

TECHNICAL FIELD OF THE INVENTION

The present invention relates to oil separators to return oil in a refrigerant that is discharged from a compressor in a refrigerating cycle apparatus such as a deep freezer and relates to refrigerating cycle apparatuses using the same.

BACKGROUND OF THE INVENTION

Conventionally deep freezers used for laboratories or the like are provided with a refrigerating cycle including a refrigerant circuit where a compressor, a condenser (radiator), a pressure reducing unit, an evaporator and the like are connected sequentially in a loop. This refrigerating cycle is filled with a refrigerant as well as a predetermined amount of oil to lubricate a sliding portion of the compressor. A part of this oil is discharged to the refrigerating cycle from the compressor together with the refrigerant.

The oil discharged to the refrigerant cycle hinders circulation of the refrigerant at the pressure reducing unit and the evaporator, and causes problems such as burning due to depletion of the oil in the compressor. To cope with the problem, an oil separator conventionally is provided between the compressor and the condenser.

This oil separator includes a tank with a predetermined capacity, into which a refrigerant (including oil) discharged from the compressor flows. Then, the oil in the refrigerant is separated in the tank with means such as a filter or a centrifugal separator, and the refrigerant only is made to flow out from the tank to the condenser. The oil is stored in the tank. A float provided in the tank floats at the oil level and is vertically movably held in the tank.

Accordingly, this float moves up and down with the oil level in the tank. Then, when the amount of the oil in the tank increases until the float rises up to a predetermined position with the oil level, a valve unit opens to let the oil in the tank return to the intake side of the compressor. Thereby, the oil discharged to the refrigerating cycle is returned, thus coping with the aforementioned problem (see Japanese Patent Application Laid-Open No. H9-72635 (Patent Document), for example).

Meanwhile, the refrigerant discharged from the compressor is at an extremely high pressure such as 3 MPa during the operation of the compressor. On the other hand, when the compressor stops, the pressure decreases to about 0.5 MPa. Accordingly the pressure in the oil separator also frequently changes between such a high pressure and a low pressure. Therefore the float is required to have strength to withstand such a large pressure change. The float is typically configured by welding two separated hemispheres (having a hollow inside) made of metal such as iron or stainless steel at their flanges, and the welding of high quality is required as well, thus increasing the manufacturing cost.

Additionally, due to metal fatigue inevitably generated in the float because of the pressure change with time, the float may lose the buoyancy by oil entering into the float through a broken portion. In that case, the float cannot detect up/down movement of the oil level and so the oil-returning function is unfortunately disabled.

In order to cope with such conventional technical problems, it is an object of the present invention to provide an oil separator capable of preventing the breakage of a float with an extremely simple configuration and a refrigerating cycle apparatus using the same.

SUMMARY OF THE INVENTION

An oil separator according to a first aspect of the present application is to separate oil in a refrigerant that is discharged from a compressor and return the oil to the compressor. The oil separator includes: a tank, into which a refrigerant discharged from the compressor flows; a float having a hollow therein that is held vertically movably in the tank, the float moving up and down with a change of an oil level in the tank; and a valve unit to return oil in the tank to the compressor in accordance with up/down movement of the float. The float includes equalizing means having one end that opens at a bottom part in the float and the other end that opens outside of the float and above the oil level in the tank.

According to a second aspect of the present application, the other end of the equalizing means in the oil separator of the aforementioned first aspect of the present application opens downward.

According to a third aspect of the present application, the other end of the equalizing means in the oil separator of the aforementioned first aspect of the present application opens obliquely upward.

According to a fourth aspect of the present application, the equalizing means in the oil separator of the aforementioned aspects of the present application is disposed along an outer face of the float.

According to a fifth aspect of the present application, the float in the oil separator of the aforementioned first to third aspects of the present application includes first and second float members each having a flange at an end face, the float members being welded at the flanges, and the equalizing means includes an equalizing path provided in the flanges.

A refrigerating cycle apparatus according to a sixth aspect of the present application includes a refrigerant circuit including a compressor, a radiator, a pressure reducing unit and an evaporator that are connected in a loop. Between the compressor and the radiator is connected the oil separator according to any one of the aforementioned first to fifth aspects of the present application.

According to the first aspect of the present application, the oil separator is to separate oil in a refrigerant that is discharged from a compressor and return the oil to the compressor, and the oil separator includes: a tank, into which a refrigerant discharged from the compressor flows; a float having a hollow therein that is held vertically movably in the tank, the float moving up and down with a change of an oil level in the tank; and a valve unit to return oil in the tank to the compressor in accordance with up/down movement of the float. The float includes equalizing means having one end that opens at a bottom part in the float and the other end that opens outside of the float and above the oil level in the tank. With this configuration, the space above the oil level in the tank and the interior of the float can communicate with each other by the equalizing means.

This configuration eliminates a pressure difference between the interior and the exterior of the float. Therefore a problem of breakage of a float due to a high pressure in the tank and a pressure change can be solved with a simple configuration even for a float with a low strength. Accordingly, burning of a compressor or cooling error of a refrigerating cycle apparatus as in the aforementioned sixth aspect of the present application can be effectively prevented while remarkably reducing the manufacturing cost. In case where oil enters into the float from the other end of the equalizing means, the oil flows out from the tank through the equalizing means when the pressure in the tank decreases, and so this configuration is free from the problem about buoyancy.

In this case, the other end of the equalizing means opening downward as in the second aspect of the present application can effectively prevent or suppress the problem that oil separated from a refrigerant flowing into the tank and typically dropping from the filter located above enters from the other end of the equalizing means.

The other end of the equalizing means opening obliquely upward as in the third aspect of the present application allows oil dropping from the above to tend to flow downward along the outer face of the equalizing means. Therefore this configuration also can effectively prevent or suppress entering of oil from the other end to the equalizing means.

The equalizing means disposed along an outer face of the float as in the fourth aspect of the present application can eliminate the necessity of providing equalizing means in the float, thus improving productivity more.

As in the fifth aspect of the present application, the float includes first and second float members each having a flange at an end face, the float members being welded at the flanges, and the equalizing means includes an equalizing path provided in the flanges. This configuration can realize equalizing means without using a pipe or the like, thus reducing the number of components and leading to the improvement of productivity.

DETAILED DESCRIPTION OF THE EMBODIMENTS

Figure 1:
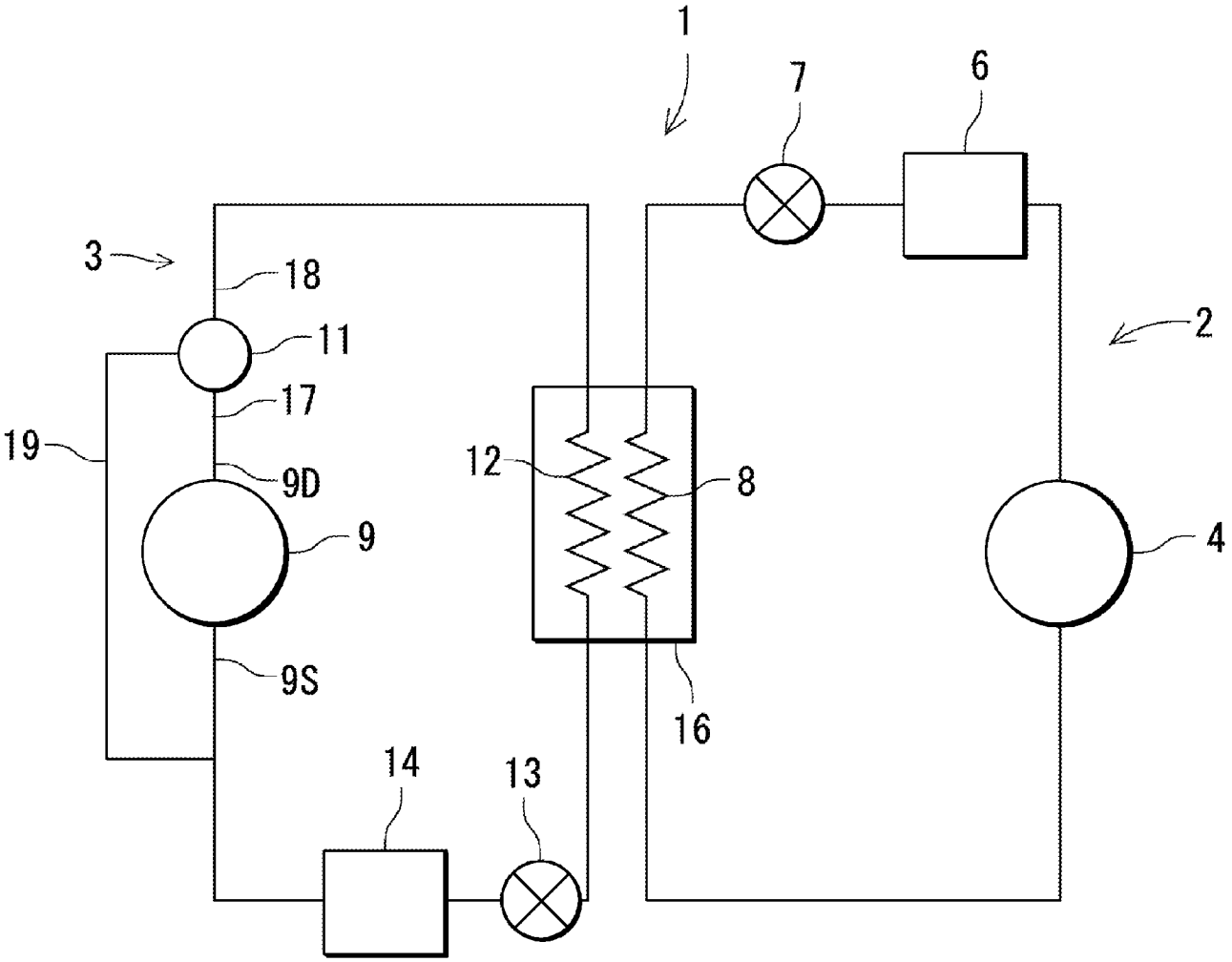
FIG. 1 is a refrigerant circuit diagram of a deep freezer that is an embodiment of a refrigerating cycle apparatus to which the present invention is applied.

The following describes embodiments of the present invention in detail, with reference to the drawings. A refrigerant circuit illustrated in FIG. 1 is to cool the chamber (not illustrated) of a deep freezer 1 that is an embodiment of a refrigerating cycle apparatus of the present invention to ultracold temperatures from −80° C. to −150° C., and the refrigerant circuit includes a high-temperature side refrigerant circuit 2 and a low-temperature side refrigerant circuit 3 cascaded to the high-temperature side refrigerant circuit 2.

The high-temperature side refrigerant circuit 2 includes: a compressor 4; a condenser 6 as a radiator; a capillary tube (or an expansion valve) 7 as a pressure reducing unit and an evaporator 8 that are connected sequentially in a loop via pipes. The low-temperature side refrigerant circuit 3 includes: a compressor 9; an oil separator 11 according to the present invention; a condenser 12 as a radiator; a capillary tube (or an expansion valve) 13 as a pressure reducing unit and an evaporator 14 that are connected sequentially in a loop via pipes. The condenser 12 of this low-temperature side refrigerant circuit 3 and the evaporator 8 of the high-temperature side refrigerant circuit 2 are arranged in a heat-exchange relationship, thus configuring a cascade heat exchanger 16.

The detailed configuration of the oil separator 11 is described later. The oil separator 11 plays a role to separate oil in a refrigerant discharged from the compressor 9 of the low-temperature side refrigerant circuit 3 and return the oil to the compressor 9, where a discharge pipe 9D of the compressor 9 of the low-temperature side refrigerant circuit 3 is connected to a refrigerant inlet pipe 17 of the oil separator 11 and a refrigerant outlet pipe 18 of the oil separator 11 is connected to the condenser 12. An oil returning pipe 19 of the oil separator 11 is connected to a suction pipe 9S of the compressor 9.

Then, when the compressor 4 of the high-temperature side refrigerant circuit 2 is operated, gas refrigerant at a high temperature and a high pressure discharged from the compressor 4 flows into the condenser 6, and dissipates heat there to condense into liquid. The refrigerant subjected to condensation at the condenser 6 then is squeezed by the capillary tube 7 and then flows into the evaporator 8 for evaporation. At this time, the refrigerant exerts an endothermic effect. The refrigerant evaporated at the evaporator 8 is sucked into the compressor 4 again for repeated circulation.

When the compressor 9 of the low-temperature side refrigerant circuit 3 is operated, gas refrigerant at a high temperature and a high pressure discharged from the discharge pipe 9D of the compressor 9 flows into the oil separator 11 through the refrigerant inlet pipe 17. Refrigerant gas from which oil has been separated by this oil separator 11 flows out from the refrigerant outlet pipe 18, and flows into the condenser 12. Herein, the oil separated by the oil separator 11 is returned to the suction pipe 9S of the compressor 9 via the oil returning pipe 19 as described later.

In order to achieve the aforementioned ultracold temperatures, the low-temperature side refrigerant circuit 3 contains a refrigerant with an extremely low boiling point therein. The refrigerant, however, can condense into liquid smoothly because the condenser 12 is cooled by the endothermic effect by the evaporator 8 of the high-temperature side refrigerant circuit 2 at the cascade heat exchanger 16. The refrigerant subjected to condensation at the condenser 12 then is squeezed by the capillary tube 13 and then flows into the evaporator 14 for evaporation. At this time, the refrigerant exerts an endothermic effect to cool the chamber not illustrated. Then the compressor 9 is turned ON and OFF in accordance with temperatures in the chamber, so that the chamber is cooled to set temperatures in the ultracold temperature range from −80° C. to −150° C. as described above.

The refrigerant evaporated at the evaporator 14 is sucked into the compressor 9 again through the suction pipe 9S for repeated circulation. At this time, the oil flowing back through the oil returning pipe 19 as well as the refrigerant from the evaporator 14 are returned to the compressor 9 via the suction pipe 9S.

Figure 2:
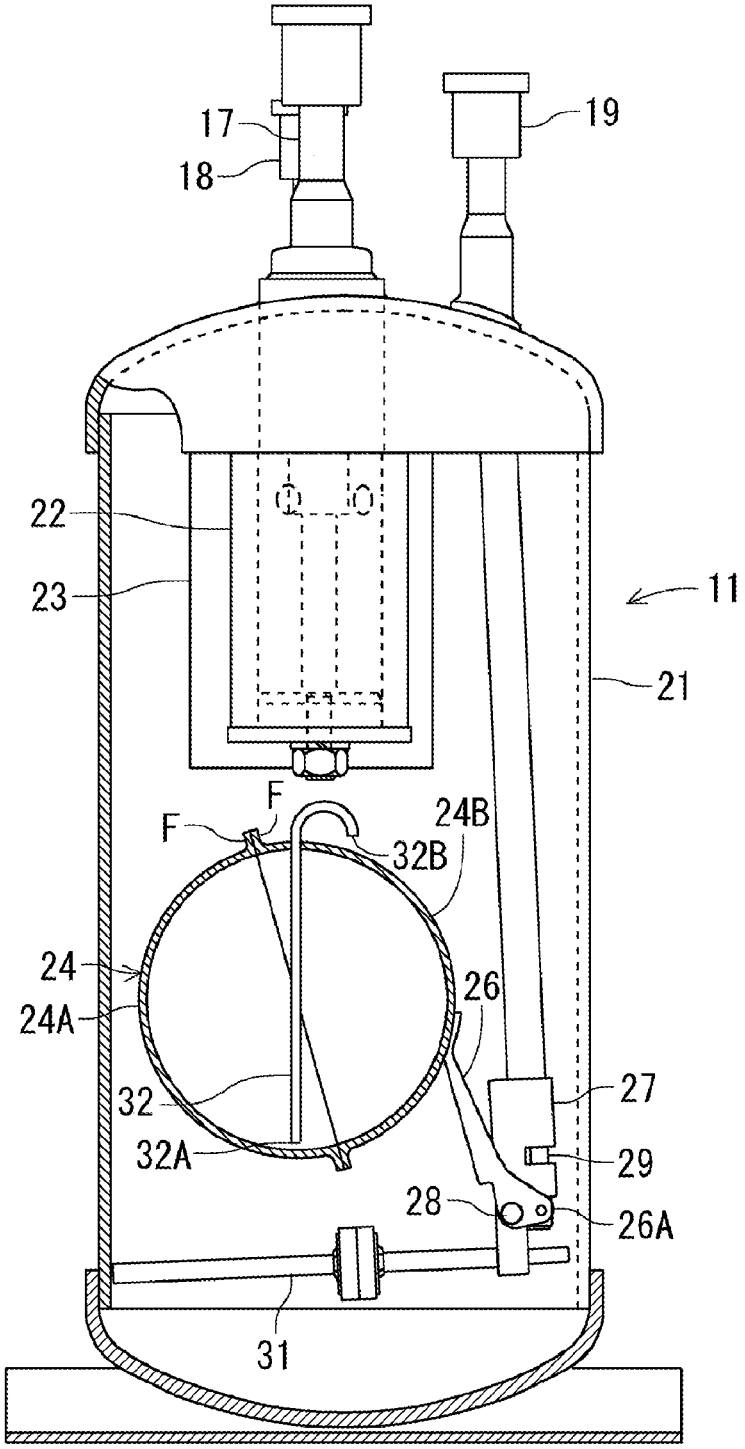
FIG. 2 is a vertical sectional view of an oil separator of the present invention.
Figure 3:
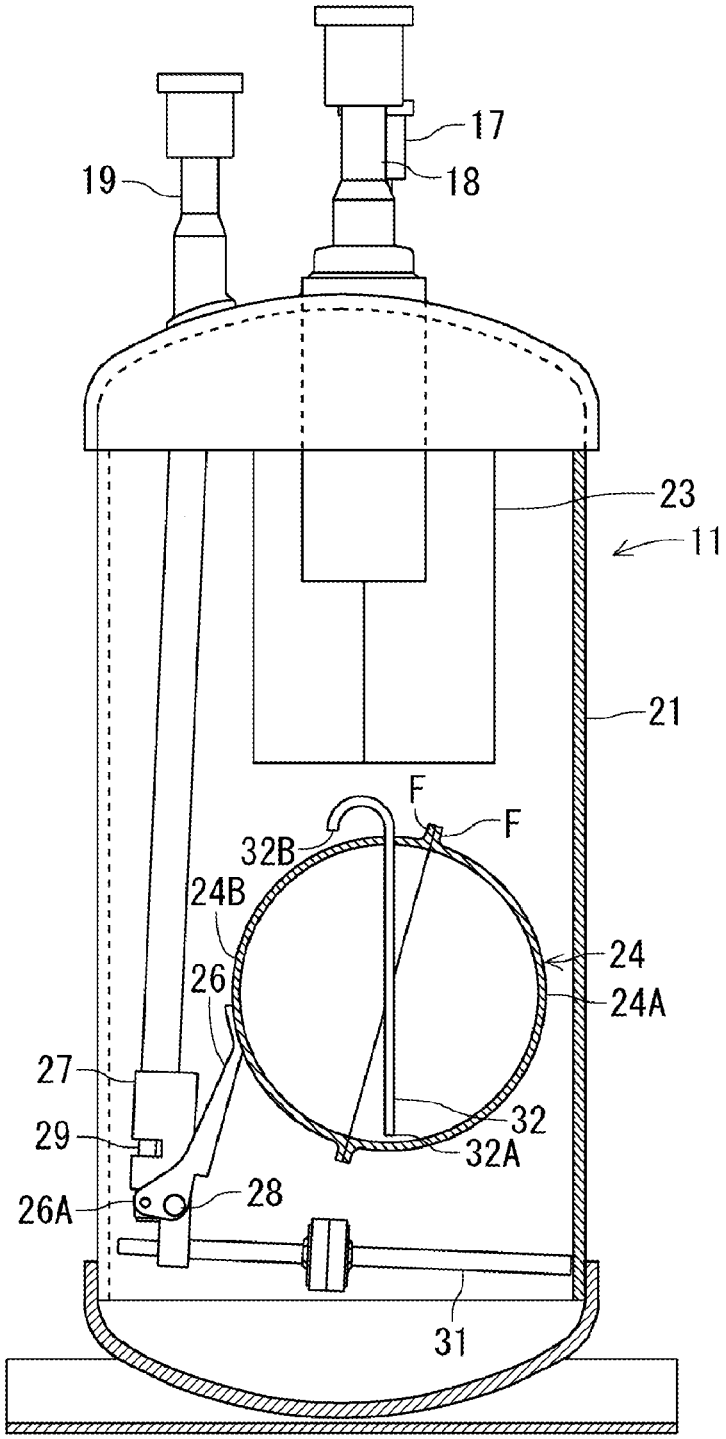
FIG. 3 is another vertical sectional view of an oil separator of the present invention.
Figure 4:
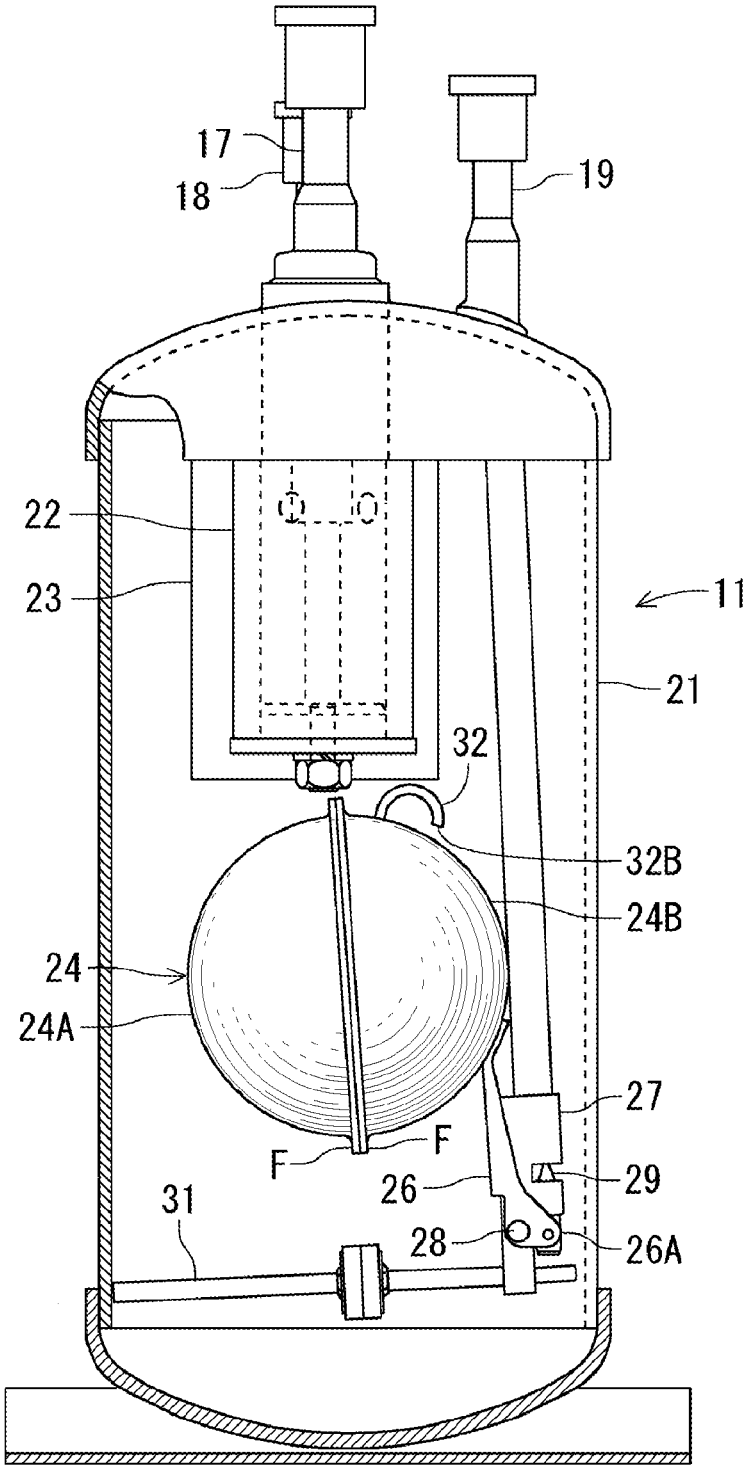
FIG. 4 illustrates the state where the float of the oil separator of FIG. 2 moves up.

The following describes one embodiment of the oil separator 11 of the present invention, with reference to FIG. 2 to FIG. 4. In these drawings, reference numeral 21 denotes a tank with a predetermined capacity having a vertically long cylindrical shape. The tank 21 is hermetically sealed above and below so as to withstand high pressures. The refrigerant inlet pipe 17 and the refrigerant outlet pipe 18 are inserted into this tank 21 from the above and open at an upper part in the tank 21. The oil returning pipe 19 also is inserted into the tank 21 from the above and opens at a bottom part in the tank 21.

Around the opening of the refrigerant inlet pipe 17 in the tank 21 is attached a filter 22, and the filter 22 separates oil in the refrigerant gas flowing from the refrigerant inlet pipe 17 as stated above. The separated oil drops from the filter 22 and is stored in the bottom part of the tank 21. The refrigerant gas from which oil has been separated by the filter 22 flows into the refrigerant outlet pipe 18 via the interior of the tank 21, and flows out to the condenser 12 from the oil separator 11. This prevents the oil from flowing out to a downstream of the oil separator 11 of the low-temperature side refrigerant circuit 3, and can avoid problems such as a failure in refrigerant circulation due to solidification of the oil at a portion at ultracold temperatures such as at the evaporator 14 as state above. The refrigerant inlet pipe 17 and the refrigerant outlet pipe 18 in the tank 21 are separated by a partition 23 to prevent a so-called short circuit of the refrigerant gas.

At the lower part of the tank 21 is housed a float 24 having a hollow therein. This float 24 floats at the oil level of the oil separated by the filter 22 and stored in the bottom part to play a role of detecting the oil level. The float 24 is held vertically movably to the oil returning pipe 19 via a float lever 26 and a mounting hardware 27.

That is, the mounting hardware 27 is attached at a lower end portion of the oil returning pipe 19, and one end portion of the float lever 26 is vertically rotatably and pivotably supported by this mounting hardware 27 around a revolution shaft 28 in the horizontal direction. Then, the other end of the float lever 26 is welded for fixing to a side face of the float 24, thus allowing the float 24 to be held vertically movably in the tank 21 below the filter 22 or the like. The one end of the float lever 26 further extends from the revolution shaft 28 in the direction opposite to the float 24, and to this extension 26A is rotatably attached a lower end of a needle valve 29 (valve unit). The upper end of this needle valve 29 corresponds to the position of the lower end opening of the oil returning pipe 19. When the needle valve 29 moves up, the upper end thereof blocks the lower end opening of the oil returning pipe 19 and when the needle valve 29 moves down, it opens the lower end opening. Reference numeral 31 denotes a holder to hold the positions of the oil returning pipe 19 and the float 24 in the tank 21.

As described above, oil separated from the refrigerant gas by the filter 22 drops from the filter 22 and is stored in the bottom part of the tank 21. The float 24 floats at the oil level of the stored oil. When the amount of the oil increases, the oil level rises and accordingly the float 24 also rises. Therefore, the float lever 26 rotates clockwise in FIG. 2 around the revolution shaft 28 and assumes the state of FIG. 4. This rotation rotates the extension 26A as well clockwise, and therefore the needle valve 29 is pulled up, thus letting the lower end opening of the oil returning pipe 19 open (FIG. 4). As a result, since the interior of the tank 21 is at a high pressure during the operation of the compressor 9, the oil stored in the tank 21 flows into the lower end opening of the oil returning pipe 19 and is returned to the compressor 9 via the oil returning pipe 19 as stated above. This can prevent burning of the compressor 9 due to depletion of the oil.

When the oil flows out, the amount of the oil in the tank 21 decreases and accordingly the oil level drops. Then, the float 24 also descends, and therefore the float lever 26 rotates counterclockwise in FIG. 2 around the revolution shaft 28. This rotation rotates the extension 26A as well counterclockwise, and therefore the needle valve 29 is pushed upward, thus blocking the lower end opening of the oil returning pipe 19 (FIGS. 2 and 3). This can adjust the oil amount in the tank 21 of the oil separator 11 always not to exceed a predetermined value.

The following describes the configuration of the float 24 in the oil separator 11 of the present invention. All of the floats 24 in the following embodiments are spheres having a hollow therein, including two separated hemispherical (having a hollow inside) first and second float members 24A and 24B made of stainless steel with flanges, which are mutually welded at the flanges F around the openings for fixing. As illustrated in FIG. 2 and FIG. 3, the second float member 24B that is the uppermost part of the float 24 in the state where the float 24 descends has a hole bored therein, through which an equalizer tube 32 made of a thin copper pipe making up equalizer means of the present invention is inserted.

A lower end 32A (one end) of this equalizer tube 32 opens at a bottom part in the float 24. In this embodiment, an upper end 32B (the other end) of the equalizer tube 32 sticks out from the float 24 and then is bent downward, and opens downward above the oil level of the oil in the tank 21. Herein, a gap between the equalizer tube 32 and the hole of the second float member 24B is sealed by welding.

As described above, during the operation of the compressor 9, since gas refrigerant at a high temperature and a high pressure is discharged from the compressor 9 and flows into the oil separator 11, the pressure in the tank 21 increases up to about 3 MPa in this embodiment. When the compressor 9 stops, the pressure in the tank 21 decreases to about 0.5 MPa. Conventionally the float members 24A and 24B configuring the float 24 and the welding portion of the flanges F are required to have a strength to withstand such a high pressure and to avoid metal fatigue due to such a pressure difference. This is because, if the float 24 breaks and oil enters into the float 24, the float will lose the buoyancy, which means that the needle valve 29 is kept close and oil cannot be returned to the compressor 9.

According to the present invention, however, the equalizer tube 32 allows the interior of the float 24 and the space above the oil level of the oil in the tank 21 to communicate with each other, thus eliminating the pressure difference between the interior and the exterior of the float 24 (pressure is equalized). As a result, the float 24 does not break without such a pressure-withstanding strength and welding quality. Accordingly, although the float in the present embodiment is made of stainless steel, the float 24 may be shaped with other metals or materials other than metal such as hard synthetic resin. Therefore, burning of the compressor 9 or cooling error of the deep freezer 1 can be effectively prevented while remarkably reducing the manufacturing cost.

Note here that the attachment of the equalizer tube 32 increases the weight of the float 24 itself, and therefore a material and dimensions of the equalizer tube 32 have to be decided with consideration given to margin of the buoyancy of the float 24. This margin of the buoyancy is decided by balance among the maximum buoyancy of the float 24 itself, the buoyancy of the float 24 around the revolution shaft 28 of the float lever 26 and moment of an application force of the needle valve 29, and therefore the material and the dimensions of the equalizer tube 32 are set so that the buoyancy can be within such margin even after the attachment of the equalizer tube 32.

In this embodiment, the float 24 is made of stainless steel, and has the volume of 137.3 (cc), the weight of 71.4 (g), the surface area of 128.7 ($cm^2$) and the maximum buoyancy of about 52.1 (g). Then, the margin of the buoyancy on the basis of the balance with the float lever 26 is about 17.9 (g). Then, when the equalizer tube 32 is made of a copper pipe as in the embodiment, the weight thereof is about 2.0 to 5.3 (g) even when the outer diameter is 2.4 to 4.76 (mm), the inner diameter is 1.2 to 3.46 (mm), the material thickness is 0.4 to 0.65 (mm) and the length is 70 (mm). Accordingly, enough buoyancy can be obtained. The same should apply to the case of using a stainless steel pipe or an iron pipe having a smaller specific gravity than a copper pipe.

Further, since the other end 32B of the equalizer tube 32 opens downward in this embodiment, oil dropping from the filter 22 located above hardly enters into the float 24 from the other end 32B of the equalizer tube 32. In case where oil enters into the float 24 from the other end 32B of the equalizer tube 32, when the compressor 9 stops and the pressure in the tank 21 decreases, oil at the bottom part in the float 24 flows from the lower end 32A of the equalizer tube 32 to the equalizer tube 32 and passes therethrough to flow out from the upper end 32B to the tank 21 as stated above. Therefore, this configuration is free from the problem of buoyancy due to the flowing oil.

However, in order to suck up oil in the float 24 with the equalizer tube 32 when the pressure in the tank 21 decreases, the equalizer tube 32 has to be filled with oil when the oil enters into the equalizer tube 32 from the lower end 32A. Although this sucking-up action is influenced by the viscosity of oil, when the inner diameter of the equalizer tube 32 is too large, oil cannot be sucked up from the float 24 when the pressure in the tank 21 decreases.

Conversely when the equalizer tube 32 is too thin, the equalizer tube 32 may be collapsed during welding to the float member 24B. Therefore, the outer diameter and the inner diameter of the equalizer tube 32 have to be selected with consideration given to these matters. In the embodiments, a copper pipe having the outer diameter of 3 (mm), the inner diameter of 2.2 (mm) and the material thickness of 0.4 (mm) was used, and it was confirmed by an experiment that the equalizer tube 32 had sufficient sucking-up ability when the pressure in the tank 21 decreases.

Figure 5:
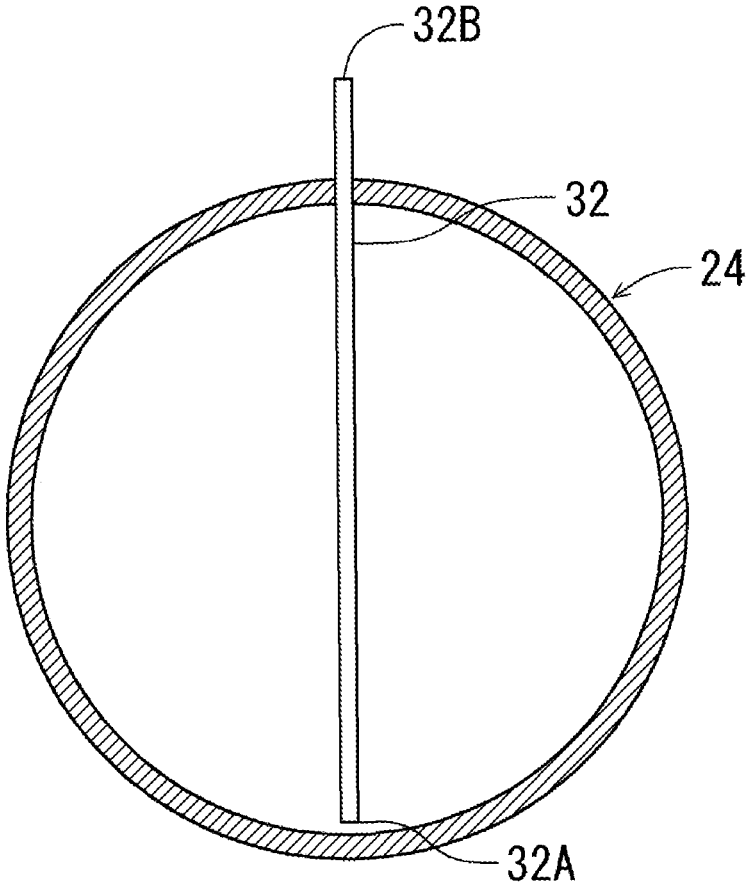
FIG. 5 illustrates another embodiment of a float of an oil separator of the present invention.

FIG. 5 is a cross-sectional view of a float 24 in another embodiment of the present invention. In this case, an equalizer tube 32 includes a straight pipe, and an upper end 32B thereof is directed upward in the tank 21. Even such an equalizer tube 32 can eliminate a pressure difference between the interior and the exterior of the float 24. However, the upper end 32B directed downward as in the aforementioned embodiment can effectively prevent or suppress the problem that oil separated from a refrigerant flowing into the tank 21 and dropping from the filter 22 located above enters from the other end 32B of the equalizer tube 32.

Figure 6:
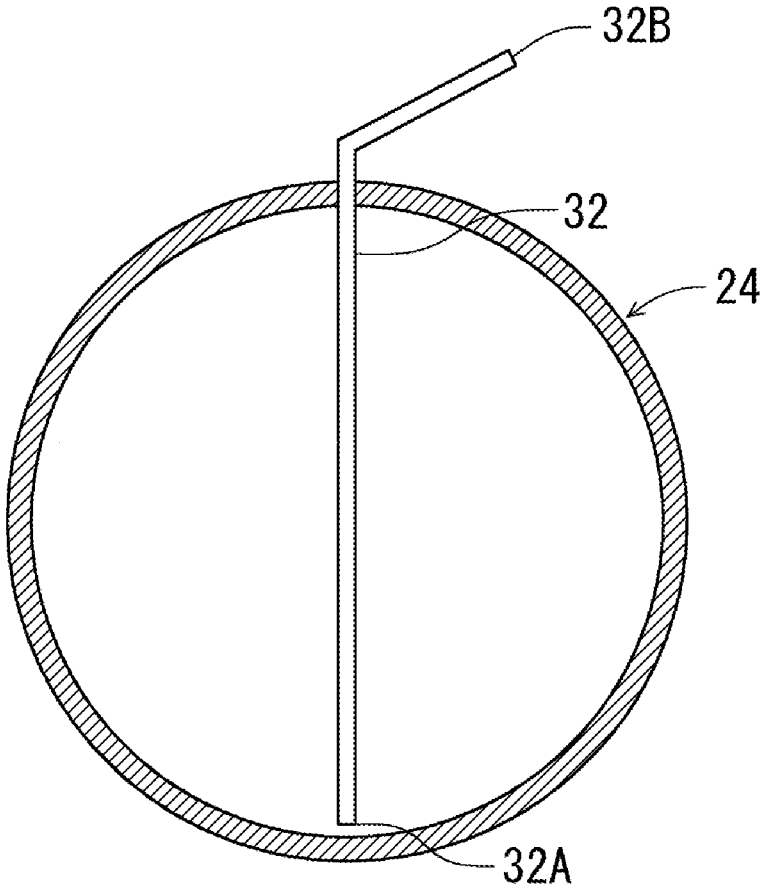
FIG. 6 illustrates still another embodiment of a float of an oil separator of the present invention.

FIG. 6 is a cross-sectional view of a float 24 in still another embodiment of the present invention. In this case, the other end 32B of the equalizer tube 32 opens to be directed obliquely upward. Such a configuration allows oil dropping from the above to tend to flow downward along the outer face of the equalizer tube 32 obliquely descending from the other end 32B, thus suppressing the oil from flowing into the equalizer tube 32 from the opening of the other end 32B, and therefore entering of the oil to the equalizer tube 32 can be effectively prevented or suppressed.

Figure 7:
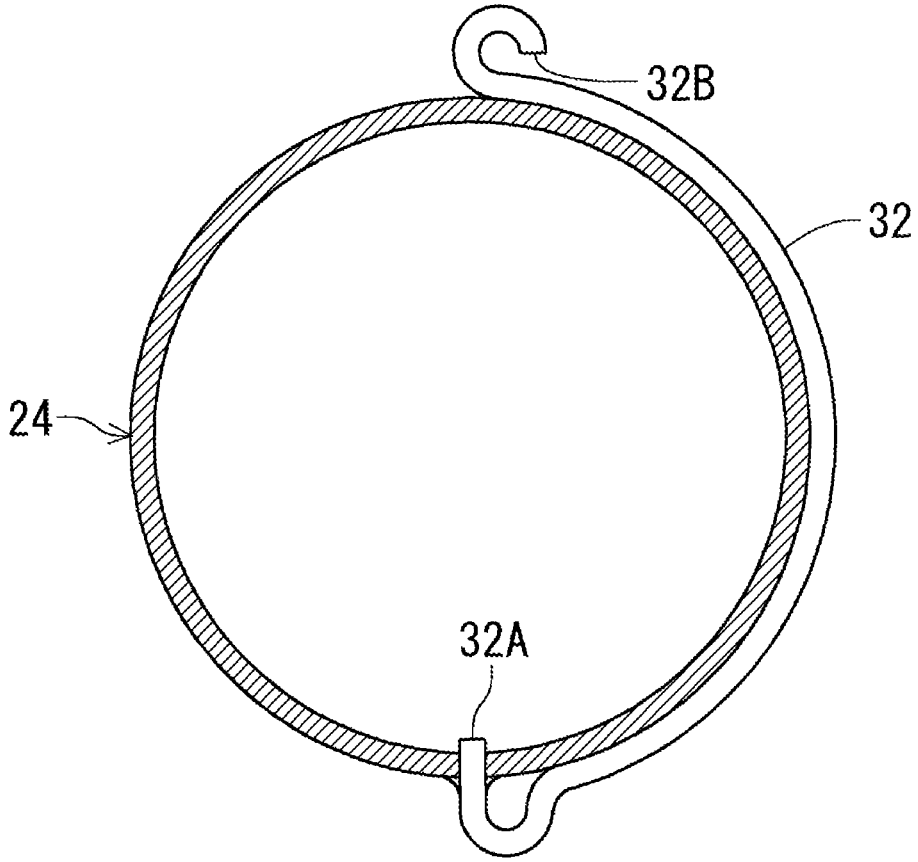
FIG. 7 illustrates a further embodiment of a float of an oil separator of the present invention.

FIG. 7 is a cross-sectional view of a float 24 in a further embodiment of the present invention. In this case, the equalizer tube 32 has a curved shape along the outer face of the float 24 and is welded for fixing to the outer face. Then, a lower end 32A thereof is inserted through a hole formed at a lower end portion of the float 24 and opens at a bottom part of the float 24. Then, similarly to the aforementioned embodiment, an upper end 32B opens downward above the float 24.

The equalizer tube 32 provided along the outer face of the float 24 in this way can eliminate the necessity to insert the equalizer tube 32 in the float 24 as in FIG. 2, FIG. 5 and FIG. 6, and therefore productivity can be more improved.

Figure 8:
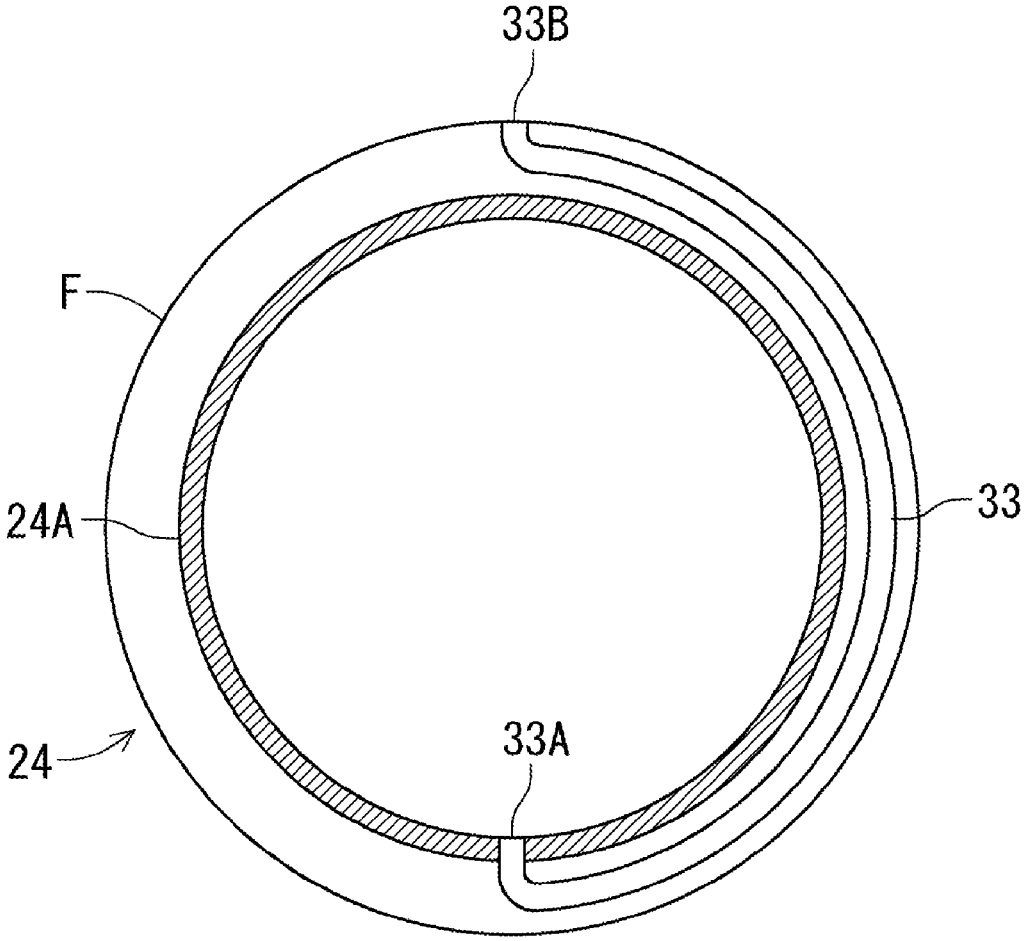
FIG. 8 illustrates a still further embodiment of a float of an oil separator of the present invention.

FIG. 8 is a cross-sectional view of a float 24 in a still further embodiment of the present invention. In this case, first and second float members 24A and 24B configuring the float 24 include grooves formed at flanges F thereof beforehand so as to be opposed mutually, and in these grooves an equalizing path (equalizing means) 33 is formed. A lower end 33A of the equalizing path 33 opens to the interior of the float 24 at a bottom portion of the float 24, and an upper end 33B of the equalizing path 33 opens externally at an upper portion of the float 24.

When forming this equalizing path 33, the flanges F at a portion other than the part corresponding to the equalizing path are mutually bonded firstly, and pressure is applied thereto to let a not-bonded portion swell. Thereby the aforementioned opposed grooves are formed at the flanges F of both of the float members 24A and 24B, and the interior therebetween becomes the equalizing path 33. The thus formed equalizing path 33 in the flanges F can eliminate the necessity of attaching a pipe, thus reducing the number of components and leading to the improvement of productivity.

In these embodiments, the present invention has been described by way of the oil separator 11 that mechanically controls the returning of oil by the vertical movement of the float 24 using the float lever 26 and the needle valve 29. The present invention, however, is not limited to such an example, and is also effective to an oil separator as in the aforementioned Patent Document 1 where the vertical movement of a float 24 opens and closes a contact and so opens and closes an electromagnetic valve (valve unit) provided at an oil returning pipe 19.

What is claimed is:

1. An oil separator to separate oil in a refrigerant that is discharged from a compressor and return the oil to the compressor, comprising:

a tank, into which a refrigerant discharged from the compressor flows;

a float having a hollow therein that is held vertically movably in the tank, the float moving up and down with a change of an oil level in the tank; and a valve unit to return oil in the tank to the compressor in accordance with up/down movement of the float, wherein the float includes equalizing means having a first end that opens at a bottom part in the float and a second end that opens outside of the float and above the oil level in the tank, wherein the second end of the equalizing means opens downward.

2. The oil separator according to claim 1, wherein the second end of the equalizing means opens obliquely upward.

3. The oil separator according to claim 1 or 2, wherein the equalizing means is disposed along an outer face of the float.

4. An oil separator to separate oil in a refrigerant that is discharged from a compressor and return the oil to the compressor, comprising:

a tank, into which a refrigerant discharged from the compressor flows;

a float having a hollow therein that is held vertically movably in the tank, the float moving up and down with a change of an oil level in the tank; and a valve unit to return oil in the tank to the compressor in accordance with up/down movement of the float, wherein the float includes equalizing means having a first end that opens at a bottom part in the float and a second end that opens outside of the float and above the oil level in the tank, wherein the float includes first and second float members each having a flange at an end face, the float members being welded at the flanges, and the equalizing means includes an equalizing path provided in the flanges.

5. A refrigerating cycle apparatus, comprising a refrigerant circuit including a compressor, a radiator, a pressure reducing unit and an evaporator that are connected in a loop, wherein between the compressor and the radiator is connected the oil separator according to claim 1 or 2.

* * * * *

UNITED STATES PATENT AND TRADEMARK OFFICE

CERTIFICATE OF CORRECTION

PATENT NO. : 9,068,769 B2
APPLICATION NO. : 13/416655
DATED : June 30, 2015
INVENTOR(S) : Tadano et al.

It is certified that error appears in the above-identified patent and that said Letters Patent is hereby corrected as shown below:

On the title page item (73)

Change

"PANASONIC HEALTHCARE CO., LTD., Toon-shi (JP)"

To

-- PANASONIC HEALTHCARE HOLDINGS CO., LTD., Toon-shi (JP) --

Signed and Sealed this
Nineteenth Day of April, 2016

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 9,068,769 B2
APPLICATION NO. : 13/416655
DATED : June 30, 2015
INVENTOR(S) : Rikio Tadano et al.

It is certified that error appears in the above-identified patent and that said Letters Patent is hereby corrected as shown below:

On the title page item (73)

Change

(73) Assignee: PANASONIC HEALTHCARE HOLDINGS CO., LTD., "Toon-shi (JP)"

To be

(73) Assignee: PANASONIC HEALTHCARE HOLDINGS CO., LTD., --Tokyo (JP)--

This certificate supersedes the Certificate of Correction issued April 19, 2016.

Signed and Sealed this
Seventeenth Day of May, 2016

Michelle K. Lee

Michelle K. Lee
*Director of the United States Patent and Trademark Office*